US009224344B2

(12) United States Patent
Chung et al.

(10) Patent No.: US 9,224,344 B2
(45) Date of Patent: Dec. 29, 2015

(54) ELECTROPHORETIC DISPLAY WITH A COMPENSATION CIRCUIT FOR REDUCING A LUMINANCE DIFFERENCE AND METHOD THEREOF

(71) Applicant: SiPix Technology, Inc., Taoyuan (TW)

(72) Inventors: Ju-Lin Chung, Taoyuan County (TW); Chi-Mao Hung, Hsinchu (TW); Wei-Min Sun, Taipei (TW); Pei-Lin Tien, Taichung (TW)

(73) Assignee: SiPix Technology, Inc., Kueishan, Taoyuan (TW)

( * ) Notice: Subject to any disclaimer, the term of this patent is extended or adjusted under 35 U.S.C. 154(b) by 0 days.

(21) Appl. No.: 14/255,949

(22) Filed: Apr. 17, 2014

(65) Prior Publication Data

US 2014/0375537 A1 Dec. 25, 2014

(30) Foreign Application Priority Data

Jun. 20, 2013 (TW) ..... 102122002 A

(51) Int. Cl.
*G09G 3/34* (2006.01)

(52) U.S. Cl.
CPC ..... *G09G 3/344* (2013.01); *G09G 2300/0842* (2013.01)

(58) Field of Classification Search
CPC ..... G09G 3/344
See application file for complete search history.

(56) References Cited

U.S. PATENT DOCUMENTS

2006/0284811 A1* 12/2006 Huang ..... G02F 1/136213 345/92
2010/0289838 A1* 11/2010 Markvoort et al. ..... 345/691
2011/0216101 A1* 9/2011 Yamada ..... 345/690
2014/0062935 A1* 3/2014 Bi ..... G06F 3/0418 345/174

FOREIGN PATENT DOCUMENTS

JP 2009069467 4/2009
JP 2012168277 A * 9/2012
TW 200643885 12/2006

* cited by examiner

*Primary Examiner* — Joseph Feild
*Assistant Examiner* — Karin Kiyabu
(74) *Attorney, Agent, or Firm* — Winston Hsu; Scott Margo

(57) ABSTRACT

An electrophoretic display includes an electrophoretic panel and a compensation circuit. The electrophoretic panel includes a common electrode, a plurality of scan lines, a plurality of data lines, a plurality of first switches, and a plurality of pixels. Each pixel of the plurality of pixels is coupled to the common electrode and coupled to a corresponding scan line and a corresponding data line through a corresponding first switch of the plurality of first switches. The compensation circuit reduces a voltage drop between a pixel voltage of the pixel and a common voltage of the common electrode when the plurality of first switches are turned off. A capacitor of the compensation circuit is coupled between each scan line and the common electrode. A second switch of the compensation circuit is turned off to float the common electrode before the plurality of first switches are turned off.

4 Claims, 4 Drawing Sheets

ELECTROPHORETIC DISPLAY WITH A COMPENSATION CIRCUIT FOR REDUCING A LUMINANCE DIFFERENCE AND METHOD THEREOF

BACKGROUND OF THE INVENTION

1. Field of the Invention

The present invention relates to an electrophoretic display and a method of operating an electrophoretic display, and particularly to an electrophoretic display and a method of operating an electrophoretic display that can utilize a compensation circuit to reduce luminance difference of an electrophoretic panel of the electrophoretic display.

2. Description of the Prior Art

Please refer to FIG. 1. FIG. 1 is a timing diagram illustrating a common voltage VCOM, a gate driving voltage VGL, a data voltage VDATA, and a pixel voltage VPIXEL corresponding to a pixel of an electrophoretic panel according to the prior art. As shown in FIG. 1, a switch coupled to the pixel is turned on when the gate driving voltage VGL is low, so a storage capacitor of the pixel can store the pixel voltage VPIXEL according to data voltage VDATA during a period T1. During a period T2, because the common voltage VCOM is increased, the pixel voltage VPIXEL is also increased with increase of the common voltage VCOM through the storage capacitor of the pixel. Before the gate driving voltage VGL is changed from low to high (a period T3), a common electrode of the electrophoretic panel is floating. When the gate driving voltage VGL is changed from low to high, the switch coupled to the pixel is turned off. Meanwhile, because a parasite capacitor exists between a scan line corresponding to the pixel and the pixel, the pixel voltage VPIXEL is increased with variation of the gate driving voltage VGL (the gate driving voltage VGL is changed from low to high) during a period T4. In addition, during the period T4, because the common electrode of the electrophoretic panel is floating before the gate driving voltage VGL is changed from low to high, variation of the common voltage VCOM is less than variation of the pixel voltage VPIXEL (a dashed line circle A as shown in FIG. 1) when the gate driving voltage VGL is changed from low to high. Thus, because variations of voltages (the pixel voltage VPIXEL and the common voltage VCOM) of two terminals of the pixel are different, luminance of electrophoretic panel is decreased when the gate driving voltage VGL is changed from low to high.

SUMMARY OF THE INVENTION

An embodiment provides an electrophoretic display. The electrophoretic display includes an electrophoretic panel and a compensation circuit. The electrophoretic panel includes a common electrode, a plurality of scan lines, a plurality of data lines, a plurality of first switches, and a plurality of pixels, where t each pixel of the plurality of pixels is coupled to the common electrode, and coupled to a corresponding scan line and a corresponding data line through a corresponding first switch of the plurality of first switches. The compensation circuit is used for reducing a voltage drop between a pixel voltage of the pixel and a common voltage of the common electrode when the plurality of first switches are turned off. The compensation circuit includes a capacitor and a second switch. The capacitor is coupled between each scan line of the plurality of scan lines and the common electrode. The second switch is coupled to the common electrode, where the second switch is turned off to float the common electrode before the plurality of first switches are turned off.

Another embodiment provides a method of operating an electrophoretic display, where the electrophoretic display includes an electrophoretic panel and a compensation circuit, the electrophoretic panel includes a common electrode, a plurality of scan lines, a plurality of data lines, a plurality of first switches, and a plurality of pixels, where each pixel of the plurality of pixels is coupled to a corresponding first switch, and coupled to a corresponding scan line and a corresponding data line through the corresponding first switch. The method includes the corresponding first switch being turned on according to a gate driving voltage of the corresponding scan line; the pixel storing a pixel voltage according to a data voltage of the corresponding data line when the corresponding first switch is turned on; the compensation circuit floating the common electrode before the corresponding first switch is turned off; and the compensation circuit increasing a common voltage of the common electrode according to the gate driving voltage when the corresponding first switch is turned off.

Embodiments of the present invention provide an electrophoretic display and a method of operating an electrophoretic display. The electrophoretic display and the method utilize a compensation circuit coupled to a common electrode of an electrophoretic panel to reduce a voltage drop between a pixel voltage of each pixel and a common voltage of the common electrode of the electrophoretic panel when a plurality of first switches of the electrophoretic panel are turned off. Thus, compared to the prior art, the embodiments of the present invention can reduce luminance difference of the electrophoretic panel.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
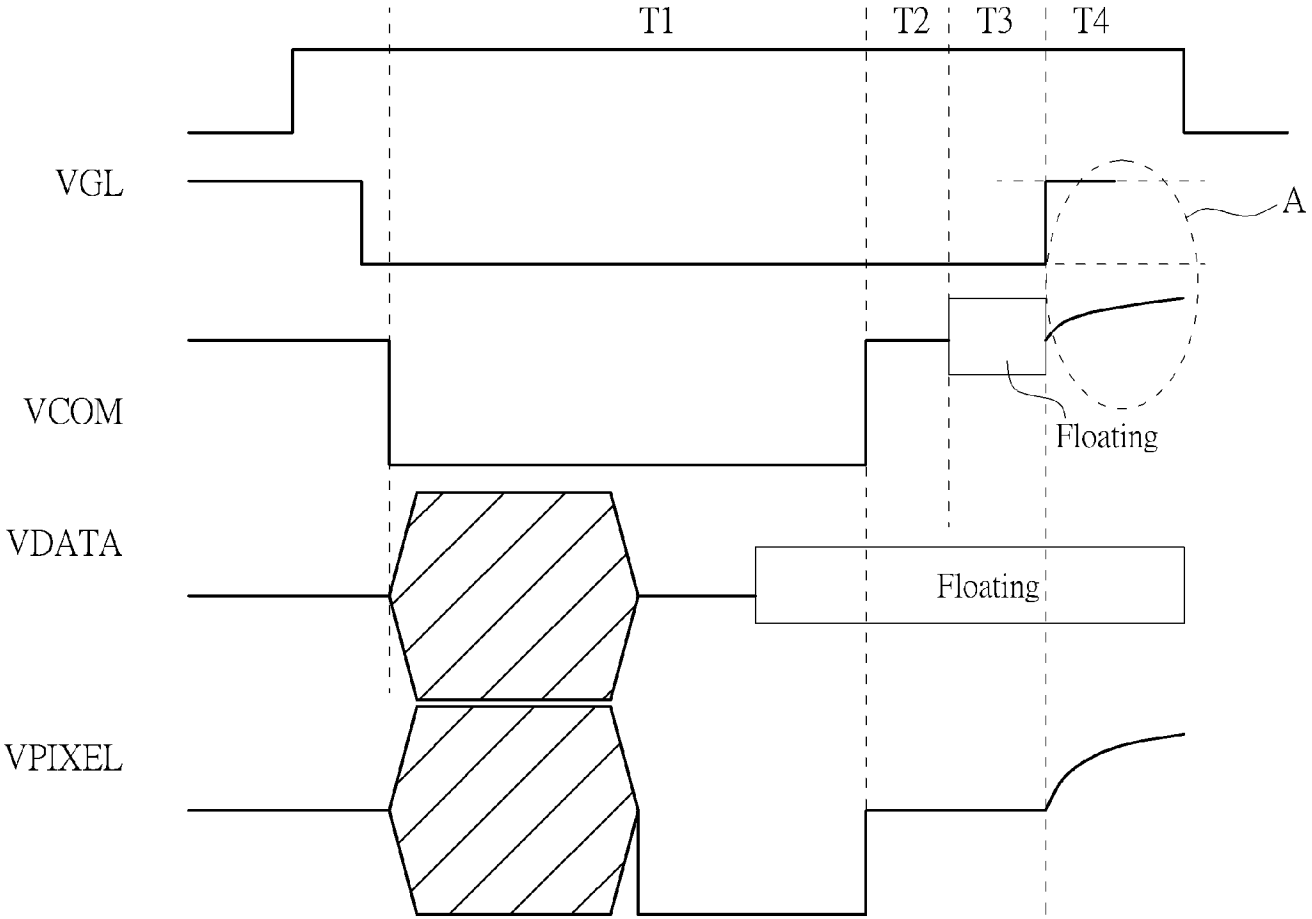
FIG. 1 PRIOR ART
FIG. 1 is a timing diagram illustrating a common voltage, a gate driving voltage, a data voltage, and a pixel voltage corresponding to a pixel of an electrophoretic panel according to the prior art.
Figure 2:
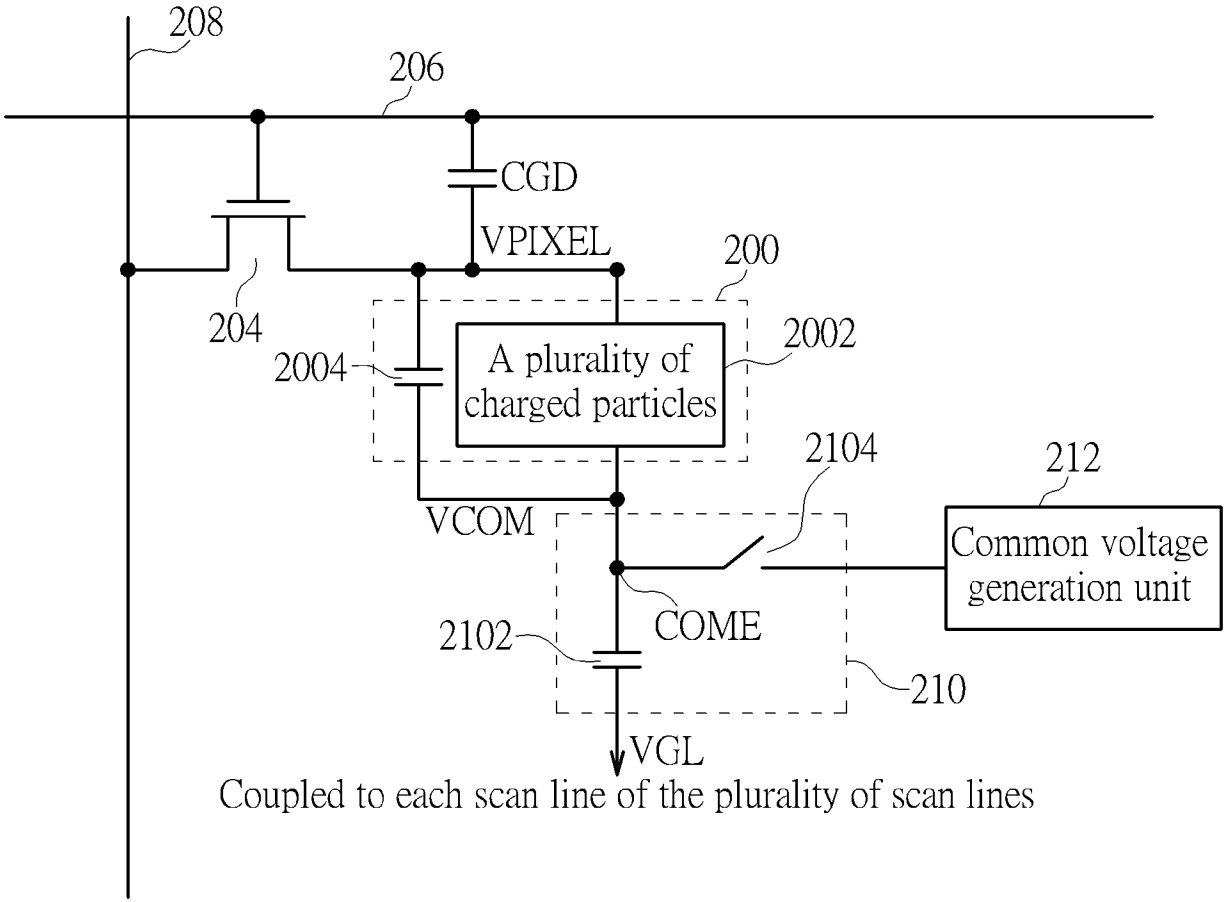
FIG. 2 is a diagram illustrating a pixel of the plurality of pixels of the electrophoretic panel.

In an embodiment of the present invention, an electrophoretic display includes an electrophoretic panel and a compensation circuit, where the electrophoretic panel includes a common electrode, a plurality of scan lines, a plurality of data lines, a plurality of first switches, and a plurality of pixels, where the plurality of first switches are thin film transistors. Please refer to FIG. 2. FIG. 2 is a diagram illustrating a pixel 200 of the plurality of pixels of the electrophoretic panel, where the pixel 200 includes a plurality of charged particles 2002 and a storage capacitor 2004. The pixel 200 is coupled to a common electrode COME, and coupled to a corresponding scan line 206 and a corresponding data line 208 through a corresponding first switch 204 of the plurality of first switches of the electrophoretic panel. The plurality of charged particles 2002 and the storage capacitor 2004 are coupled between the corresponding first switch 204 and the common electrode COME. A compensation circuit 210 is used for reducing a voltage drop between a pixel voltage VPIXEL of the pixel 200 and a common voltage VCOM of the common electrode COME when the plurality of first switches of the electrophoretic panel are turned off. As shown in FIG. 2, the compensation circuit 210 includes a capacitor 2102 and a second switch 2104, where the second switch 2104 is a thin film transistor. The capacitor 2102 is coupled between each scan line of the plurality of scan lines of the electrophoretic panel and the common electrode COME. The second switch 2104 is coupled between the common electrode COME and a common voltage generation unit 212, where the second switch 2104 is also turned off to float the common electrode COME when the plurality of first switches of the electrophoretic panel are turned off, and the common voltage generation unit 212 is used for generating the common voltage VCOM.

Figure 3:
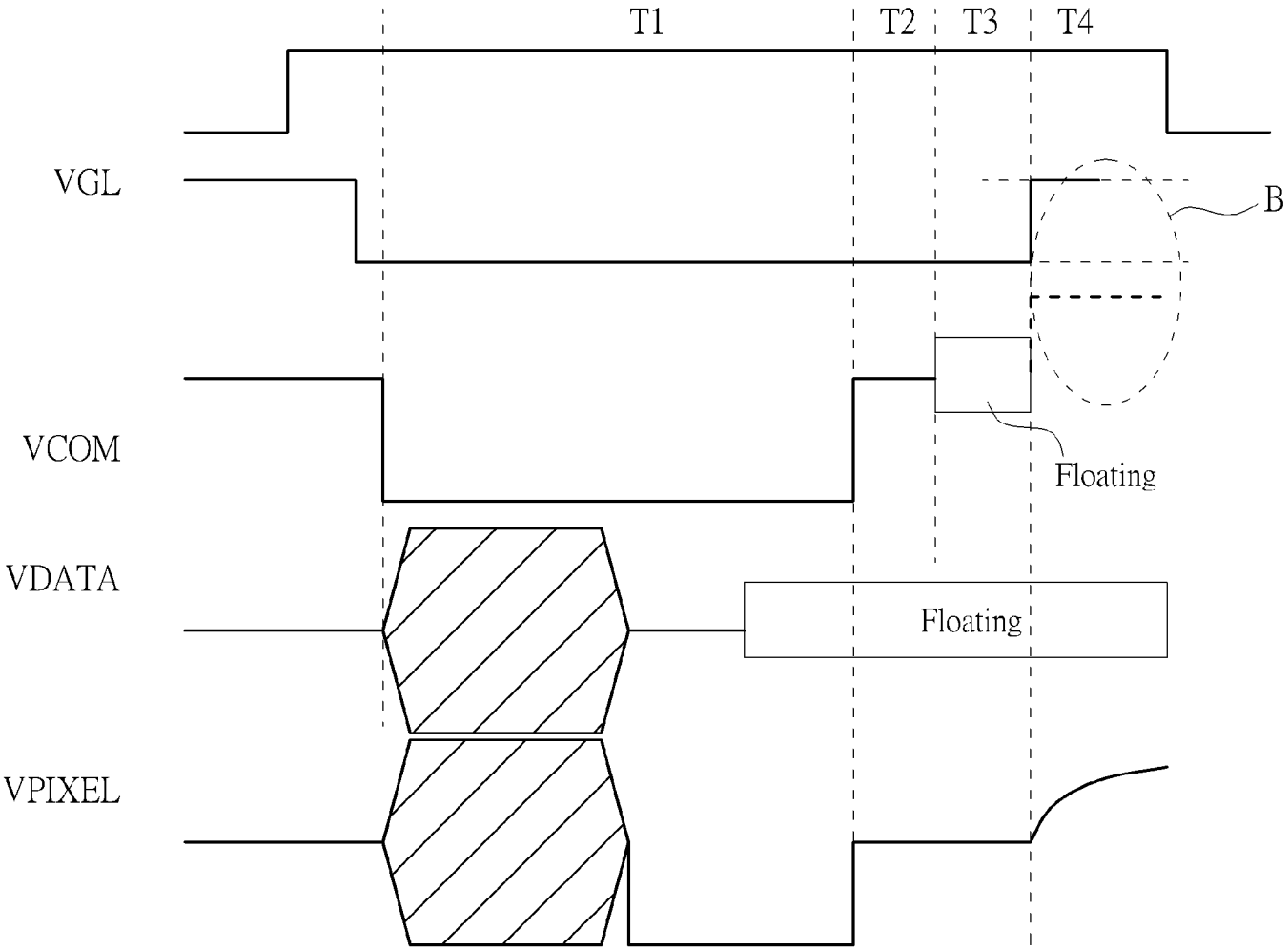
FIG. 3 is a timing diagram illustrating the common voltage, a gate driving voltage, a data voltage, and the pixel voltage corresponding to the pixel.

Please refer to FIG. 3. FIG. 3 is a timing diagram illustrating the common voltage VCOM, a gate driving voltage VGL, a data voltage VDATA, and the pixel voltage VPIXEL corresponding to the pixel 200. As shown in FIG. 3, when the gate driving voltage VGL is low, the first switch 204 coupled to the pixel 200 is turned on, so the storage capacitor 2004 of the pixel 200 can store the pixel voltage VPIXEL according to the data voltage VDATA of the corresponding data line 208 during a period T1, where the plurality of charged particles 2002 can be moved to a corresponding position according to the pixel voltage VPIXEL. During a period T2, because the common voltage VCOM is increased, the pixel voltage VPIXEL is also increased with increase of the common voltage VCOM through the storage capacitor 2004. Before the gate driving voltage VGL is changed from low to high (a period T3), the second switch 2104 is turned off to float the common electrode COME. When the gate driving voltage VGL is changed from low to high, the first switch 204 is turned off. Meanwhile, because a parasite capacitor CGD exists between the corresponding scan line 206 and the pixel 200, the pixel voltage VPIXEL is increased with variation of the gate driving voltage VGL (the gate driving voltage VGL is changed from low to high) during a period T4. In addition, during the period T4, although the common electrode COME of the electrophoretic panel is floating (because the second switch 2104 is turned off) before the gate driving voltage VGL is changed from low to high, the common voltage VCOM is also increased (a dashed line circle B as shown in FIG. 3) with the variation of the gate driving voltage VGL (the gate driving voltage VGL is changed from low to high) when the gate driving voltage VGL is changed from low to high because the capacitor 2102 is coupled between the corresponding scan line 206 and the common electrode COME. Thus, because variations of voltages (the pixel voltage VPIXEL and the common voltage VCOM) of two terminals of the pixel 200 are similar, luminance difference of the electrophoretic panel is reduced when the gate driving voltage VGL is changed from low to high.

Figure 4:
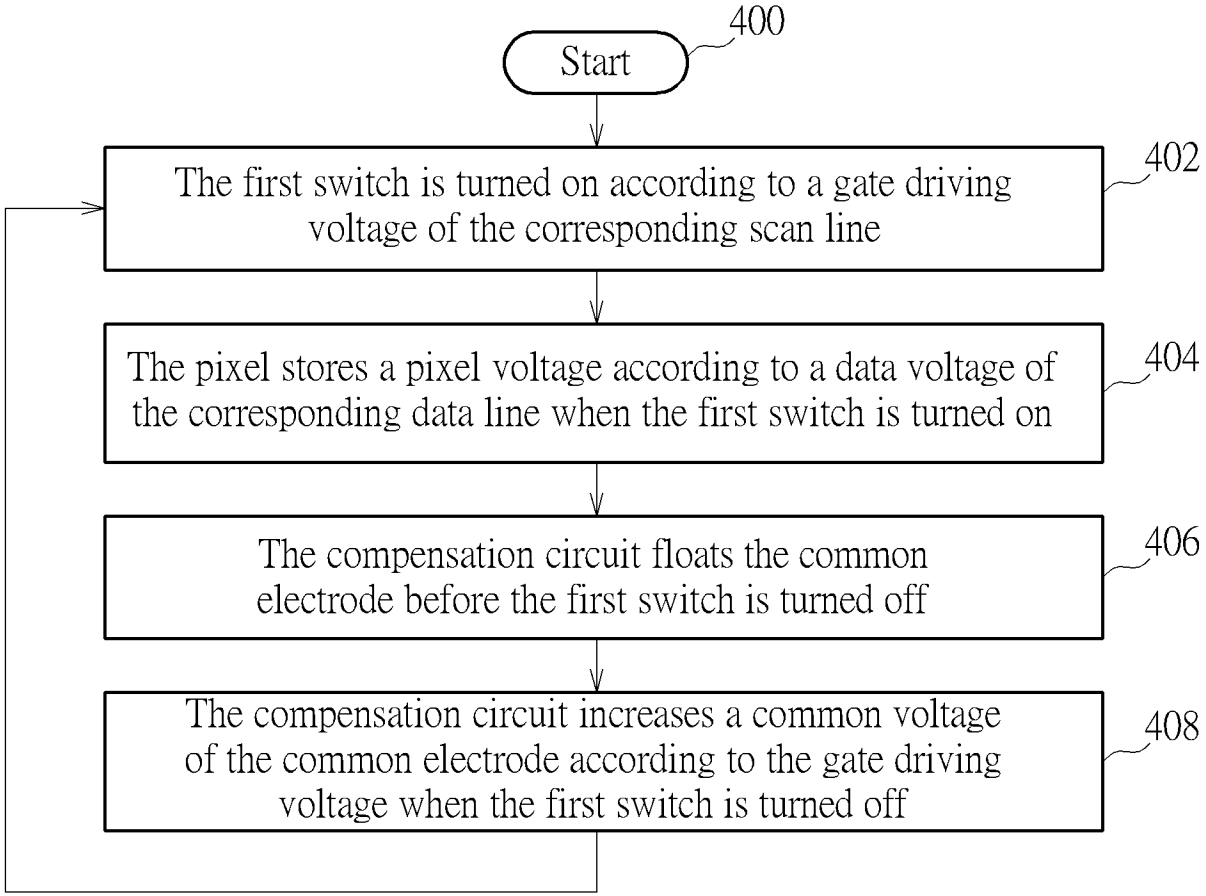
FIG. 4 is a flowchart illustrating a method of operating an electrophoretic display according to another embodiment.

Please refer to FIG. 2, FIG. 3, and FIG. 4. FIG. 4 is a flowchart illustrating a method of operating an electrophoretic display according to another embodiment. The method in FIG. 4 is illustrated using the pixel 200 in FIG. 2. Detailed steps are as follows:

Step 400: Start.

Step 402: The first switch 204 is turned on according to a gate driving voltage VGL of the corresponding scan line 206.

Step 404: The pixel 200 stores a pixel voltage VPIXEL according to a data voltage VDATA of the corresponding data line 208 when the first switch 204 is turned on.

Step 406: The compensation circuit 210 floats the common electrode COME before the first switch 204 is turned off.

Step 408: The compensation circuit 210 increases a common voltage VCOM of the common electrode COME according to the gate driving voltage VGL when the first switch 204 is turned off, go to Step 402.

In Step 402, as shown in FIG. 3, when the gate driving voltage VGL is low, the first switch 204 coupled to the pixel 200 is turned on. In Step 404, because the first switch 204 is turned on, the storage capacitor 2004 of the pixel 200 can store the pixel voltage VPIXEL according to the data voltage VDATA of the corresponding data line 208 during the period T1, where the plurality of charged particles 2002 within the pixel 200 can be moved to a corresponding position according to the pixel voltage VPIXEL. During the period T2, because the common voltage VCOM is increased, the pixel voltage VPIXEL is also increased with increase of the common voltage VCOM through the storage capacitor 2004. In Step 406, during the period T3, the second switch 2104 of the compensation circuit 210 is turned off to float the common electrode COME before the gate driving voltage VGL is changed from low to high (that is, before the first switch 204 is turned off). In Step 408, during the period T4, the first switch 204 is turned off when the gate driving voltage VGL is changed from low to high. Meanwhile, because the parasite capacitor CGD exists between the corresponding scan line 206 and the pixel 200, the pixel voltage VPIXEL is increased (as shown in period T4) with variation of the gate driving voltage VGL (the gate driving voltage VGL is changed from low to high). In addition, because the common electrode COME of the electrophoretic panel is floating (because the second switch 2104 is turned off), the common voltage VCOM is increased (the dashed line circle B as shown in FIG. 3) with the variation of the gate driving voltage VGL (the gate driving voltage VGL is changed from low to high) when the gate driving voltage VGL is changed from low to high. Thus, because variations of voltages (the pixel voltage VPIXEL and the common voltage VCOM) of two terminals of the pixel 200 are similar, luminance difference of the electrophoretic panel is reduced when the gate driving voltage VGL is changed from low to high.

To sum up, the electrophoretic display and the method of operating the electrophoretic display provided by the above mentioned embodiments of the present invention utilize the compensation circuit coupled to the common electrode of the electrophoretic panel to reduce a voltage drop between a pixel voltage of each pixel and a common voltage of the common electrode of the electrophoretic panel when the plurality of first switches of the electrophoretic panel are turned off. Thus, compared to the prior art, the above mentioned embodiments of the present invention can reduce luminance difference of the electrophoretic panel when a gate driving voltage VGL is changed from low to high.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electrophoretic display, comprising:

an electrophoretic panel comprising:

a common electrode;

a plurality of scan lines;

a plurality of data lines;

a plurality of first switches; and a plurality of pixels, wherein a pixel of the plurality of pixels has a terminal coupled to the common electrode, and another terminal coupled to a corresponding scan line and a corresponding data line through a corresponding first switch of the plurality of first switches, and the pixel comprises a storage capacitor coupled between the corresponding first switch and the common electrode for storing the pixel voltage according to a data voltage of the corresponding data line when the corresponding first switch is turned on; and a compensation circuit coupled between the common electrode of the electrophoretic panel and each scan line of the plurality of scan lines for reducing a voltage drop between a pixel voltage of the pixel and a common voltage of the common electrode when the plurality of first switches are turned off, wherein the compensation circuit comprises:

a capacitor coupled between each scan line of the plurality of scan lines and the common electrode; and a second switch coupled to the common electrode, wherein the second switch is turned off to float the common electrode before the plurality of first switches are turned off.

2. The electrophoretic display of claim 1, wherein the pixel further comprises a plurality of charged particles.

3. The electrophoretic display of claim 1, wherein the plurality of first switches and the second switch are thin film transistors.

4. A method of operating an electrophoretic display, the electrophoretic display comprising an electrophoretic panel and a compensation circuit, the electrophoretic panel comprising a common electrode, a plurality of scan lines, a plurality of data lines, a plurality of first switches, and a plurality of pixels, wherein each pixel of the plurality of pixels is coupled to a corresponding first switch, and coupled to a corresponding scan line and a corresponding data line through the corresponding first switch, and the compensation circuit comprising a capacitor coupled between a corresponding scan line and the common electrode and a second switch coupled between the common electrode and a common voltage source, the method comprising:

the corresponding first switch being turned on according to a gate driving voltage of the corresponding scan line;

the pixel storing a pixel voltage according to a data voltage of the corresponding data line when the corresponding first switch is turned on;

the compensation circuit floating the common electrode by turning off the second switch before the corresponding first switch is turned off; and the compensation circuit increasing a common voltage of the common electrode by supplying the gate driving voltage to the common electrode through the capacitor of the compensation circuit when the corresponding first switch is turned off.

* * * * *